US011037770B2

(12) United States Patent
Breuer

(10) Patent No.: US 11,037,770 B2
(45) Date of Patent: Jun. 15, 2021

(54) DIFFERENTIAL COATING OF HIGH ASPECT RATIO OBJECTS THROUGH METHODS OF REDUCED FLOW AND DOSING VARIATIONS

(71) Applicant: PHOTONIS SCIENTIFIC, INC., Sturbridge, MA (US)

(72) Inventor: Matthew Breuer, Hadley, MA (US)

(73) Assignee: PHOTONIS SCIENTIFIC, INC., Fiskdale, MA (US)

( * ) Notice: Subject to any disclaimer, the term of this patent is extended or adjusted under 35 U.S.C. 154(b) by 0 days.

(21) Appl. No.: 16/460,300

(22) Filed: Jul. 2, 2019

(65) Prior Publication Data

US 2020/0006042 A1 Jan. 2, 2020

Related U.S. Application Data

(60) Provisional application No. 62/693,076, filed on Jul. 2, 2018.

(51) Int. Cl.
*H01J 43/06* (2006.01)
*H01J 9/24* (2006.01)

(52) U.S. Cl.
CPC ..... *H01J 43/06* (2013.01); *H01J 9/24* (2013.01)

(58) Field of Classification Search
CPC .. H01J 43/06; H01J 43/08; H01J 43/10; H01J 43/28
USPC ..... 313/249
See application file for complete search history.

(56) References Cited

U.S. PATENT DOCUMENTS

| | | | | |
|---|---|---|---|---|
| 3,488,509 | A | 1/1970 | Goodrich | |
| 3,899,706 | A * | 8/1975 | Ball | H01J 43/10 313/105 R |
| 4,298,817 | A | 11/1981 | Carrette et al. | |
| 5,726,076 | A | 3/1998 | Tasker et al. | |
| 7,189,432 | B2 | 3/2007 | Chiang et al. | |
| 8,052,884 | B2 | 11/2011 | Sullivan et al. | |
| 8,912,526 | B2 | 12/2014 | Nutzel et al. | |
| 8,921,799 | B2 | 12/2014 | Elam et al. | |
| 2009/0212680 | A1 | 8/2009 | Tremsin et al. | |
| 2013/0043378 | A1* | 2/2013 | Schreiber | H01L 31/024 250/238 |
| 2013/0240907 | A1 | 9/2013 | Nutzel et al. | |
| 2016/0314947 | A1 | 10/2016 | Mane et al. | |
| 2019/0164734 | A1 | 5/2019 | Kobayashi et al. | |

FOREIGN PATENT DOCUMENTS

WO 2007001301 A2 1/2007

* cited by examiner

*Primary Examiner* — Christopher M Raabe
(74) *Attorney, Agent, or Firm* — Dann, Dorfman, Herrell and Skillman, P.C.

(57) ABSTRACT

A channel electron multiplier having a high aspect ratio and differential coatings along its channel length is disclosed. The elongated tube has an input end, an output end, and an interior surface extending along the length of the tube between the input end and the output end. The channel electron multiplier also has first and second conductive layers formed on the interior surface of the tube. The first conductive layer is selected to provide a first electrical resistance, a first electron emission characteristic, or both, and the second conductive layer is selected to provide a second electrical resistance, a second electron emission characteristic, or both. A method of making a channel electron multiplier having two or more different conductive layers is also disclosed.

11 Claims, 4 Drawing Sheets

DIFFERENTIAL COATING OF HIGH ASPECT RATIO OBJECTS THROUGH METHODS OF REDUCED FLOW AND DOSING VARIATIONS

CROSS REFERENCE TO RELATED APPLICATION

This application claims the benefit of U.S. Provisional Patent Application No. 62/693,076, filed Jul. 2, 2018, the entirety of which is incorporated by reference herein.

BACKGROUND OF THE INVENTION

Field of the Invention

This invention relates generally to the formation of coatings on a high aspect ratio object and in particular to a method of forming such coatings by atomic layer deposition to provide two or more coating layers and/or chemistries in different zones along the length of the object. The invention also relates to a channel electron multiplier having two are more resistive coating layers in different zones along the length of the channel electron multiplier. The invention also relates to a channel electron multiplier having one or two or more conducting or insulating layers in different zones along the length of the channel electron multiplier.

Description of the Related Art

Electron multipliers have been used as detectors in mass spectrometers for many years. There are currently three basic types of multipliers in use. The first type is the discrete dynode multiplier. Discrete dynode multipliers have the advantage of being able to produce high output currents (e.g., in excess of 100 μA). Being composed primarily of metals, insulators, and ceramics they do well in applications where certain introduced chemicals would degrade materials such as glass used in fabricating other detector types. However, they are bulky and relatively complicated and can be expensive to manufacture. The second type of multiplier is the continuous dynode multiplier. The vast majority of these devices are fabricated using a glass tube, although some are constructed from coated ceramic materials or are a combination of glass and ceramic. The continuous dynode multipliers are, in general, made with fewer parts than discrete dynode multipliers and are structurally more robust and much less complex than the discrete dynode type. The third electron multiplier type is a multichannel plate, also referred to simply as an MCP. This type of multiplier is typically a thin flat plate usually round in shape, but they can be fabricated in a variety of shapes. It contains thousands of micron-scaled short electron multiplication channels. These plates typically are biased to lower voltages than the other two detector types, are fragile and easily broken, are more expensive to manufacture and are very susceptible to atmospheric moisture. They excel in applications where electrons or ions are spread over an area rather than in tightly collimated beams, and in applications where very short signal pulse widths are required. The emissive surfaces of all three detector types have been treated in various ways with coatings developed in the industry over the last several years such that they are much less susceptible or even in some cases made immune to problems caused by atmospheric exposure.

The known electron multipliers are constructed to receive a charged particle such as an electron or ion and provide an amplified signal corresponding to the received particle. In a discrete dynode multiplier, the signal is amplified by the secondary emission of electrons as the charged particle impinges on the surface of a first dynode and by the subsequent generation of additional electrons as the secondary electrons impinge on subsequent dynodes in the multiplier. In a continuous dynode multiplier, the signal is amplified by the secondary emission of electrons from the interior surface of the multiplier tube as the initial charged particle and subsequent secondary electrons impinge on the interior surface of the tube.

A known single channel electron multiplier (CEM) is manufactured by PHOTONIS Scientific, Inc. and sold under the registered trademark CHANNELTRON®. The CHANNELTRON CEM's are durable and efficient detectors of positive and negative ions as well as electrons and photons. The CHANNELTRON CEM includes a glass tube having an inner diameter of approximately 1 mm and an outer diameter of 2, 3, or 6 mm. The tube is constructed from a specially formulated lead silicate glass. When appropriately processed, this glass exhibits the properties of electrical conductivity and secondary emission which are essential to electron multiplication. CEM tubes typically have a high aspect ratio.

More recently, CEM's have been produced by depositing multiple atomic layers of a material that is resistively conductive and is capable of secondary electron emission. The use of such atomic layer deposition (ALD) techniques provides an advantage in the uniformity and consistency of the resistively conductive layer inside the CEM tube. However, the use of ALD has been limited to the production of a single uniform coating on the CEM interior surface. It would be advantageous to be able to provide a CEM in which the emissive layer is varied along the length of the tube so different electron multiplication effects can be obtained. Such an arrangement would provide much greater flexibility in the design and manufacture of CEM's than is presently known.

BRIEF SUMMARY OF THE INVENTION

In accordance with a first aspect of this invention there is provided a channel electron multiplier that includes a high aspect ratio elongated tube having a length (L) and an internal diameter (D) wherein L>>D. The elongated tube has an input end, an output end, and an interior surface extending along the length of the tube between the input end and the output end. The channel electron multiplier also has first and second sections of conductive layers formed on the interior surface of the tube. The first conductive layer is formed on the interior surface in a first zone of the elongated tube. The first conductive layer has a length $I_1$ that is less than L and the first conductive layer is selected to provide a first electrical resistance, a first electron emission characteristic, or both. The second conductive layer is formed on the interior surface in a second zone of the elongated tube that does not overlap with the first zone. The second conductive layer has a length $I_2$ that is the difference between L and $I_1$. The second conductive layer is selected to provide a second electrical resistance, a second electron emission characteristic, or both. The channel electron multiplier of this invention also includes a first electrode formed on the elongated tube at the input end thereof and a second electrode formed on the elongated tube at the output end thereof. Although the foregoing describes embodiments of the method as applied to detectors fabricated from straight tubes it is to be understood the invention applies to CEMs having any channel shape or form either singly or in combination with other sections.

In accordance with a second aspect of this invention there is provided a method of making a channel electron multiplier. The method includes the step of providing a high aspect ratio elongated tube having a length (L) and an internal diameter (D) wherein L>>D. The elongated tube also has an input end, an output end, and an interior surface extending along the length of the tube between the input end and the output end. The method also includes the step of forming a first resistively conductive layer on the interior surface in a first zone of the elongated tube such that the first resistively conductive layer has a length $I_1$ that is less than L. The first conductive layer is selected to provide a first electrical resistance, a first electron emission characteristic, or both. The method further includes the step of forming a second conductive layer on the interior surface in a second zone of the elongated tube that does not overlap with the first zone. The second conductive layer is formed such that it has a length $I_2$ that is the difference between L and $I_1$. The second conductive layer is selected to provide a second electrical resistance, a second electron emission characteristic, or both. The method also includes the steps of forming a first electrode on the elongated tube at the input end thereof and forming a second electrode on the elongated tube at the output end thereof.

Here and throughout this specification the term "aspect ratio" means the ratio of the length (L) of an object to its internal diameter or width (D). The terms "high aspect ratio" and "L>>D" mean an aspect ratio of from at least 35 to well over 1,000.

BRIEF DESCRIPTION OF THE DRAWINGS

The foregoing summary of the invention as well as the following detailed description of the invention will be better understood when read with reference to the drawings wherein.

DETAILED DESCRIPTION OF THE INVENTION

Figure 1:
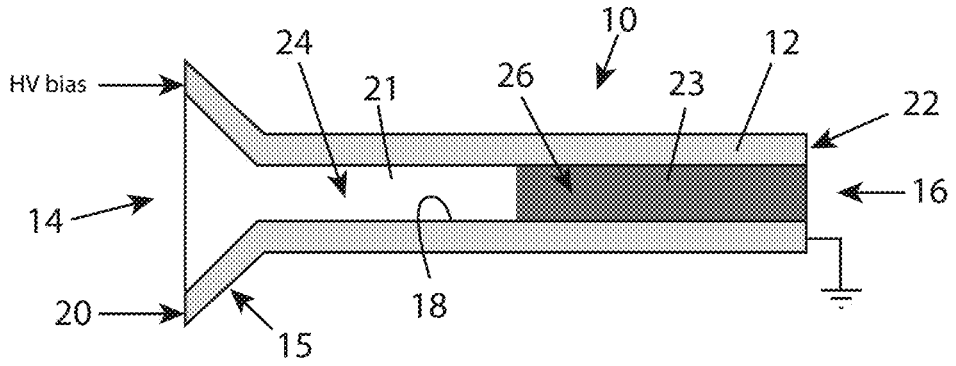
FIG. 1 is a schematic view of a first embodiment of a channel electron multiplier according to the invention having two discrete coatings.

Referring now to FIG. 1, there is shown schematically a channel electron multiplier 10 that has been internally coated in accordance with the present invention. The channel electron multiplier 10 includes an elongated tube 12 that is preferably formed from glass, but which may also be formed from another suitable material known to those skilled in the art, such as a suitable ceramic material. The tube 12 has an input end 14, an output end 16, and an internal surface 18 that extends from the input end 14 to the output end 16. The input end 14 sometimes includes a flared opening that is preferably conical in shape as known in the art. Although the tube 12 shown in FIG. 1 is straight, it is contemplated that the tube can also be arcuate, circular, or spiral in shape.

The edge of the input end 14 has a metallic conductive layer 20 formed thereon and the edge of the output end 16 has a second metallic conductive layer 22 formed thereon. The conductive layers 20 and 22 constitute electrodes that can be connected to a suitable electrical bias potential. In the embodiment shown in FIG. 1 the conductive layer 20 is connectable to a high voltage biasing potential and the conductive layer 22 is connectable to a lower potential, preferably ground potential.

A first coating 21 of an electrically resistive material is formed on the internal surface 18 of tube 12 in a first zone 24 thereof. A second coating 23 of a different electrically resistive material is formed on the internal surface 18 in a second zone 26. The first and second coatings are adjacent but do not overlap each other. They are, however, sufficiently in contact at their common boundary to provide a continuous conduction path through the entire channel. The material for the first coating 21 is selected to provide an electrical resistance R1 and the material for the second coating 23 is selected to provide a second electrical resistance R2 that is different from R1. R1 may be greater than R2 or R2 may be greater than R1 depending on the detection application for the channel electron multiplier.

Figure 2:
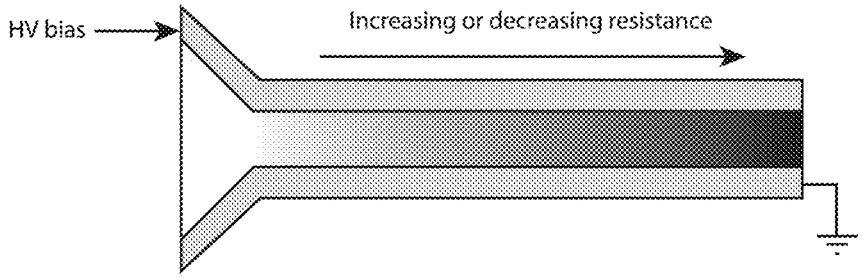
FIG. 2 is a schematic view of a second embodiment of the channel electron multiplier according to the invention having a gradient electrical resistance along its length.

It is also contemplated that the channel electron multiplier according to the present invention can be made with more than two coating zones. Referring to FIG. 2, there is shown a second embodiment of a channel electron multiplier according to the invention. The embodiment shown in FIG. 2 has a graduated electrical resistance along the internal surface of the tube. The graduated resistance is provided by forming a plurality of resistive coatings in very small, adjacent zones sequentially along the length of the internal surface. The coating in each zone is selected to provide an incrementally different electrical resistance relative to the coatings in the adjacent zones on either side. Thus, the coating materials can be selected to provide a gradually increasing electrical resistance from the input end to the output end or a gradually decreasing electrical resistance from the input end to the output end.

Figure 3:
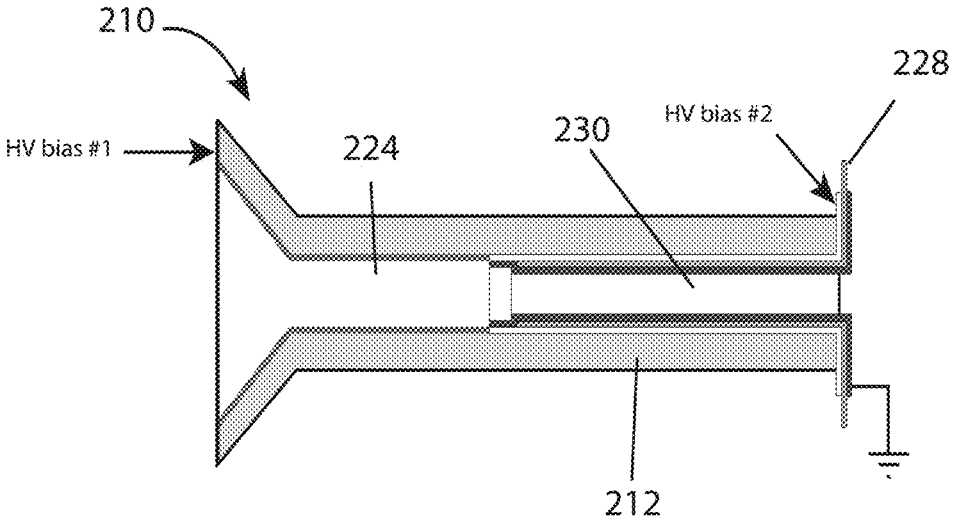
FIG. 3 is a schematic view of a third embodiment of the channel electron multiplier according to the invention having two discrete resistive/emissive coatings and a second biasing electrode.
Figure 4:
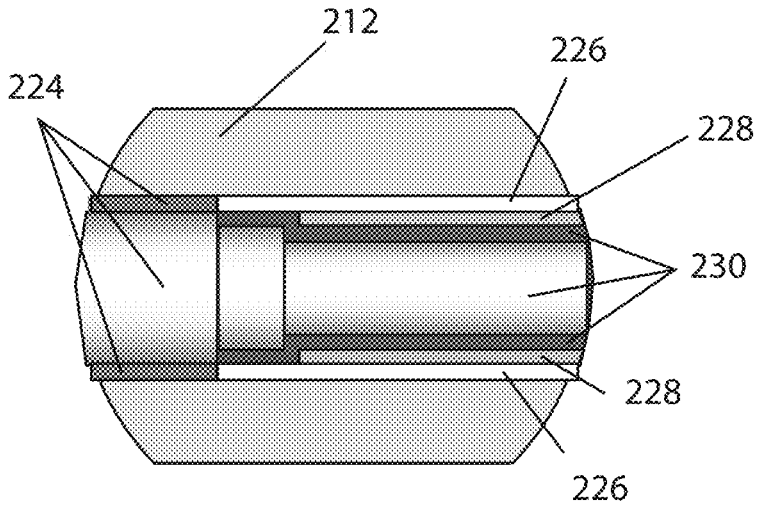
FIG. 4 is an enlarged schematic view of a first portion of the channel electron multiplier of FIG. 3.
Figure 5:
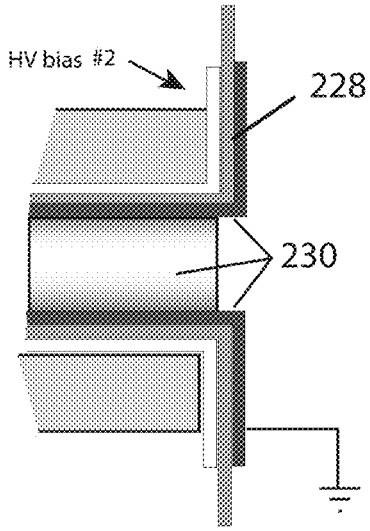
FIG. 5 is an enlarged schematic view of a second portion of the channel electron multiplier of FIG. 3.

Shown in FIGS. 3, 4 and 5 is a third embodiment of the channel electron multiplier 210 according to the present invention. The channel electron multiplier shown in FIGS. 3, 4, and 5 has all of the features of the channel electron multiplier of FIG. 1 and further includes structure that permits the device to have a second biasing voltage applied. As shown in FIGS. 3, 4, and 5 the channel electron multiplier 210 has a first coating 224 in a first zone (Zone 1) of the internal surface of the elongated tube. In a second zone (Zone 2) of the internal surface, layers of coatings are formed on the internal surface. As shown in FIGS. 4 and 5, a metallic, electrically conductive layer 226 is formed directly on the internal surface of the tube 212. A layer of electrically insulating material 228 is formed on the conductive layer 226 and a layer of electrically resistive material 230 is formed on the electrical insulating layer 228. Preferably, the electrically insulating layer 228 and the electrically resistive layer 230 are formed concentrically with each other and with the conductive layer 226. The metallic conductive layer 226 has a portion that extends beyond the insulating material 228 and the resistive material 230 so that the conductive layer 226 can be connected to a bias potential having a magnitude that is different from the bias potential applied to the input electrode.

A channel electron multiplier according to the first embodiment (FIG. 1) of the present invention can be made by carrying out an atomic layer deposition (ALD) process that includes a combination of steps that are performed in a sequence designed to provide two or more different coatings on the interior wall surface of an elongated tube substrate. The elongated tube substrate generally has a length L and a diameter D where L>>D. In a first step of the process a first conductive layer is formed on the interior surface in a first zone of the elongated tube. The first conductive layer is preferably formed by blocking a first end of the tube 12 (e.g., input end 14) to prevent penetration by precursor material through that end and then depositing a conductive material by atomic layer deposition through the open end of the tube 12 (e.g., output end 16). The blocking method can be any technique that would be readily apparent to a person skilled in the art. However, the technique used should provide sufficient sealing capability, provide resistance to heat generated during the deposition process, and substantially avoid damage to the coating when the blocking material is removed. The first step is carried out under conditions of time and dosing concentration that are selected to provide the first conductive layer along a length $I_1$ of the tube that is less than L. The first conductive layer is made from a material that is selected to provide a first electrical resistance, a first electron emission characteristic, or both.

In a second step, a second conductive layer is formed on the interior surface in a second zone of the elongated tube which does not overlap with the first zone. The second conductive layer is preferably formed by unblocking the first end of the tube, blocking the opposite end of the tube, and then depositing a second conductive material by atomic layer deposition through the unblocked end of the tube. The second step is carried out under conditions of time and dosing concentration selected to provide the second conductive layer along a length $I_2$ that is also less than L. The second conductive layer is made from a material that is selected to provide a second electrical resistance, a second electron emission characteristic, or both that is different from the first electrical resistance and/or the first electron emission characteristic.

Figure 6:
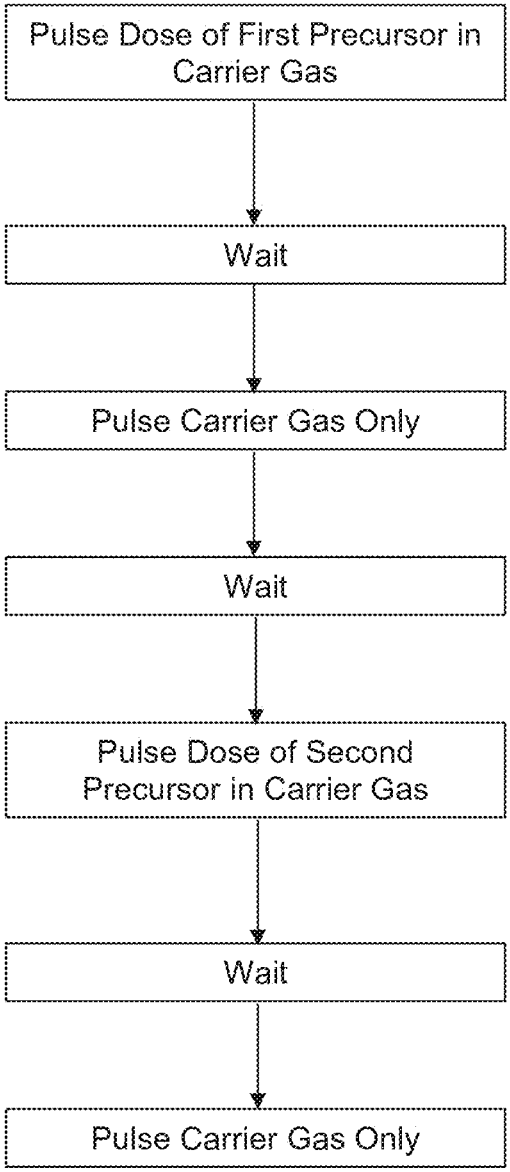
FIG. 6 is a flow diagram of a process for making a channel electron multiplier according to the invention.

The first and second steps described above are preferably carried out by using a commercially available ALD coating apparatus such as the Model TFS 200 equipment manufactured by Beneq Oy, a company located in Vantaa, Finland. When using such an apparatus, the first conductive layer is preferably formed according to the following sequence as illustrated in FIG. 6. A preselected amount (dose) of a first precursor material is pulsed into the elongated tube by means of an inert carrier gas such as nitrogen. The process is held for a period of time that is selected to allow the first precursor to propagate along the tube interior and deposit on the inner surface of the elongated tube along the length $I_1$. At the end of the hold period the carrier gas alone is pulsed into the elongated tube to clear out undeposited remnants of the first precursor. A preselected dose of the second precursor material is then pulsed into the elongated tube with the carrier gas. The process is held for a period of time that is selected to allow the second precursor to propagate along the tube interior and deposit on the inner surface of the tube along the length $I_1$. The first and second precursors react to form the first conductive layer. At the end of the second hold period the carrier gas by itself is again pulsed into the elongated tube to clear out undeposited and unreacted remnants of the second precursor. Depth of penetration of the coating along a channel is controlled by adjusting the precursor dosing quantity and pulse duration.

The second conductive layer can be formed by a similar sequence in which a different dose of the first precursor material is pulsed into the elongated tube at the opposite end by means of an inert carrier gas such as nitrogen. The process is held for a period of time that is selected to allow the first precursor to propagate along the tube interior and deposit on the inner surface of the elongated tube along the length $I_2$. At the end of the hold period the carrier gas alone is pulsed into the elongated tube to clear out undeposited remnants of the first precursor. A different dose of the second precursor material is then pulsed into the elongated tube with the carrier gas. The process is held for a time period that is selected to allow the second precursor to propagate along the tube interior and deposit on the inner surface of the tube along the length $I_2$. The first and second precursors react to form the second conductive layer. At the end of the second hold period the carrier gas by itself is again pulsed into the elongated tube to clear out undeposited and unreacted remnants of the second precursor.

Figure 7:
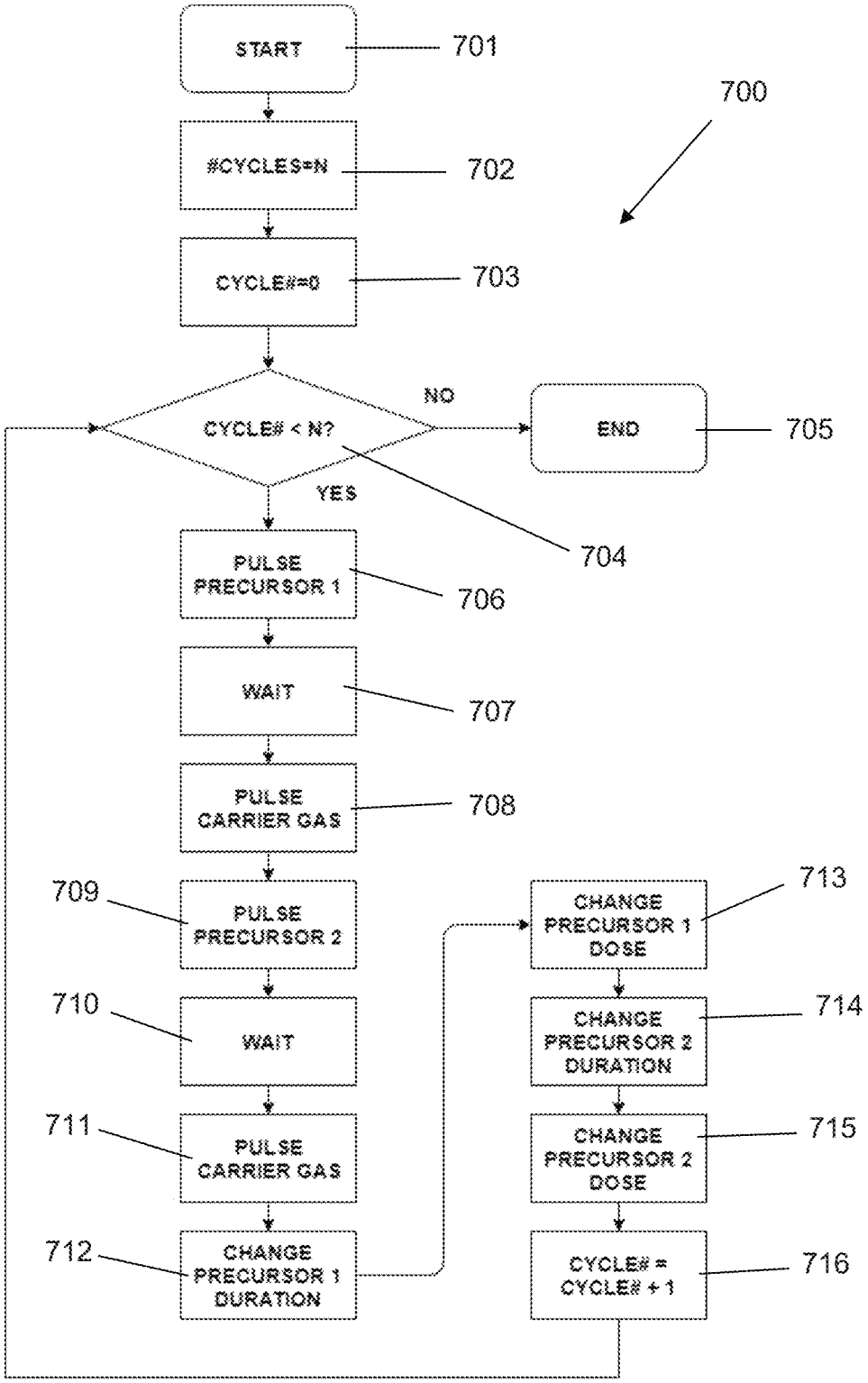
FIG. 7 is a flow diagram of a process for making a channel electron multiplier according to the embodiment of FIG. 2.

A channel electron multiplier according to the second embodiment (FIG. 2) of the present invention is produced by utilizing a sequence comprising multiple steps to provide the plurality of very short adjacent zones of conductive material each zone having a different resistance value relative to its adjacent zones. The combination of the plurality of zones having different resistance values results in a resistance gradient along the length of the tube. The resistance gradient can be formed to provide either an increasing resistance gradient or a decreasing resistance gradient along the length of the tube as needed for a particular application. An example process 700 for producing such an embodiment will be described with reference to FIG. 7. Prior to carrying out the coating process the initial pulse duration and the initial dosing value (concentration) for the first precursor are selected and set in the controller of the coating apparatus. The initial pulse duration and the initial dosing value for the second precursor are also selected and set in the coating apparatus controller. After those parameters have been set, the process can proceed as shown in FIG. 7. Depending upon whether the resistance is to be increasing from the input end 14 to the output end 16, or vice versa, the end of the tube where the resistance is to be greatest is blocked as described above. Then the coating proceeds as follows.

The process sequence starts in step 701 and proceeds first to step 702 wherein the desired number of coating cycles (n) is selected and set in the apparatus controller. Each coating cycle includes depositing a resistive, conductive coating in a small zone along the tube as described above. In step 703 the initial cycle number (Cycle #) is set to 0. The process then proceeds to step 704 wherein the current value of the cycle number is compared to "n" to see if the maximum number of cycles have been run. As shown in FIG. 7, this step is performed by testing whether the current cycle number is less than "n". If the test returns the value NO, then the process is ended in step 705. However, if the test returns the value YES, then the process proceeds to step 706.

In step 706, a preselected amount (dose) of a first precursor material is pulsed into the elongated tube by means of an inert carrier gas. The process is paused in step 707 for a time period that is sufficient to allow the first precursor to propagate along the tube interior and deposit on the inner surface of the elongated tube along a length $I_1$. After the hold period the carrier gas alone is pulsed into the elongated tube in step 708 to clear out undeposited remnants of the first precursor. A preselected dose of the second precursor material is then pulsed into the elongated tube with the carrier gas in step 709. The process is again paused in step 710 for a time sufficient to allow the second precursor to propagate along the tube interior, deposit on the inner surface of the tube along the length $I_1$, and react with the first precursor. At the end of the second hold period the carrier gas by itself is again pulsed into the elongated tube in step 711 to clear out undeposited and unreacted remnants of the second precursor. The first and second precursors react to form the first conductive layer in the first zone.

The process then proceeds for depositing another resistive layer that covers the first section and extends past it further into the succeeding uncoated portion of the channel. To that end the pulse duration of the first precursor is changed (step 712), the dose value of the first precursor is changed (step 713), the pulse duration of the second precursor is changed (step 714), and the dose value of the second precursor is changed (step 715). In steps 712-715 the pulse times and/or dose values will be incremented such that an increasingly resistive gradient is produced from the open end to the blocked end of the tube. After the pulse durations and dose values are changed, the cycle number is incremented in step 716 and the process returns to step 704 where the cycle number is again tested relative to the maximum number of cycles. If the test returns the value YES, then steps 705-716 are repeated with the changed precursor pulse durations and the changed precursor dose values. The procedure is repeated until the desired number of resistive zones are deposited on the inner surface of the elongated tube, thereby coating its entire length.

It will be apparent to anyone skilled in the art that the practice of successively incrementing to longer pulse durations and dosings to successively produce the coating from the open end toward the closed end of the detector could also be done in reverse. The operator could start with a pulse duration and dose sufficient to coat the entire length of the channel from open to closed end, then reduce the pulse duration and/or dose such that the coating does not penetrate the full length of the channel. The next sequence would use a yet shorter pulse duration and/or dose for yet less penetration, and so forth until the desired coating is achieved. In this way the resulting coating is the same: thicker for lower resistance at the beginning of the channel to thinner for higher resistance at the end of the channel.

As a result of performing the sequence of processing steps described above and shown in FIG. 7, a series of very small coating increments are deposited adjacent to each other along the length of the inner surface of the tube. A channel electron multiplier formed in this manner will effectively function as if the electrical resistance is continuously varying along the interior of the tube. It is further contemplated that the sequence shown in FIG. 7 and described above can be modified to provide a channel resistance that not only varies in a linear manner but which also could be formed to vary in a non-linear way as a function of distance along its length such as in accordance with a quadratic or exponential mathematical function. In this way, it would be possible to "tune" the channel electron multiplier in a virtually unlimited number of resistive coating variations depending on the particular detection application the multiplier is designed for use in.

A channel electron multiplier according the third embodiment (FIG. 3) can be formed by utilizing a process or combination of processes similar to those described above for the embodiments shown in FIGS. 1 and 2. However, additional steps for depositing the metallic conductive layer (226) and the insulating layer (228) between the inner surface of the tube and the electrically resistive coating (230) would be included.

It will be recognized by those skilled in the art that changes or modifications may be made to the above-described embodiments without departing from the broad inventive concepts of the invention. It is understood, therefore, that the invention is not limited to the particular embodiments which are described, but is intended to cover all modifications and changes within the scope and spirit of the invention as described above and set forth in the appended claims.

The invention claimed is:

1. A channel electron multiplier comprising:

an elongated tube having a length (L) and an internal diameter (D) wherein L>>D, said elongated tube having an input end, an output end, and an interior surface that defines a channel extending along the length of said tube between the input end and the output end;

a first conductive layer formed on the interior surface of a first zone of said elongated tube, said first conductive layer having a length $I_1$ that is less than L, wherein the first conductive layer is selected to provide a first electrical resistance, a first electron emission characteristic, or both;

a second conductive layer formed on the interior surface of a second zone of said elongated tube wherein the second zone does not overlap with the first zone, said second conductive layer having a length $I_2$ that is the difference between L and $I_1$ wherein the second conductive layer is selected to provide a second electrical resistance, a second electron emission characteristic, or both;

a first electrode formed on the elongated tube at the input end thereof; and a second electrode formed on the elongated tube at the output end thereof.

2. The channel electron multiplier as set forth in claim 1 wherein the first and second conductive layers are in contact at their common boundaries so as to provide a continuous conductive path along the channel.

3. The channel electron multiplier as set forth in claim 1 comprising a plurality of additional conductive layers formed on the interior surfaces of a plurality of additional zones adjacent to the first zone and the second zone of said elongated tube wherein the plurality of additional zones are adjacent to each other and each of the additional conductive layers has a length that is less than L and wherein each of the plurality of conductive layers is selected to provide an electrical resistance that is greater than or less than the conductive layer in an adjacent zone, whereby a resistance gradient is provided along the length L of the channel.

4. The channel electron multiplier as set forth in claim 1 comprising:

an insulating layer of electrical insulating material formed along an interior surface of the second conductive layer; and a resistive layer of electrically resistive material formed along an interior surface of the insulating layer;

wherein the second conductive layer has a portion that extends radially beyond the insulating layer and the resistive layer and the resistive layer has a portion that extends beyond the insulating layer and is connected to the second electrode.

5. The channel electron multiplier as set forth in claim 4 wherein the insulating layer is concentric with the second conductive layer and the resistive layer is concentric with the insulating layer and the second conductive layer.

6. A method of making a channel electron multiplier comprising the steps of:

providing an elongated tube having a length (L) and an internal diameter (D) wherein L>>D, said elongated tube having an input end, an output end, and an interior surface extending along the length of said tube that defines a channel between the input end and the output end;

forming a first conductive layer on the interior surface in a first zone of said elongated tube, said first conductive layer having a length $I_1$ that is less than L, wherein the first conductive layer is selected to provide a first electrical resistance, a first electron emission characteristic, or both;

forming a second conductive layer on the interior surface in a second zone of said elongated tube wherein the second zone does not overlap with the first zone, said second conductive layer having a length $I_2$ that is the difference between L and $I_1$, wherein the second conductive layer is selected to provide a second electrical resistance, a second electron emission characteristic, or both;

forming a first electrode on the elongated tube at the input end thereof; and forming a second electrode on the elongated tube at the output end thereof.

7. The method as set forth in claim 6 wherein the first and second conductive layers are formed such that they are in contact at their common boundaries so as to provide a continuous conductive path through the entire channel.

8. The method as set forth in claim 6 wherein the step of forming the first conductive layer comprises the steps of:

pulsing a dose of a first precursor material in a carrier gas into the tube;

waiting for the dose of the first precursor material to propagate along the inside of the tube and deposit on the interior surface along the length $I_1$;

pulsing a dose of the carrier gas only into the tube;

waiting for the dose of the carrier gas to clear out undeposited remnants of the first precursor material;

pulsing a dose of a second precursor material in the carrier gas into the tube;

waiting for the dose of the second precursor material to propagate along the inside of the tube and deposit on the interior surface along the length $I_1$; and then pulsing a second dose of the carrier gas only into the tube.

9. The method as set forth in claim 8 wherein the step of forming the second conductive layer comprises the steps of:

pulsing a dose of a third precursor material in a carrier gas into the tube;

waiting for the dose of the third precursor material to propagate along the inside of the tube and deposit on the interior surface along the length $I_2$;

pulsing a dose of the carrier gas only into the tube;

waiting for the dose of the carrier gas to clear out undeposited remnants of the third precursor material;

pulsing a dose of a fourth precursor material in the carrier gas into the tube;

waiting for the dose of the fourth precursor material to propagate along the inside of the tube and deposit on the interior surface along the length $I_2$; and then pulsing a second dose of the carrier gas only into the tube.

10. The method as set forth in claim 6 comprising the step of forming a plurality of additional conductive layers on the interior surfaces of a plurality of additional zones adjacent to the first zone and the second zone of said elongated tube wherein the plurality of additional zones are formed adjacent to each other and each of the additional conductive layers is formed to have a length that is less than L and wherein each of the plurality of conductive layers is selected to provide an electrical resistance that is greater than or less than the conductive layer in an adjacent zone, whereby a resistance gradient can be provided along the length L of the channel.

11. The method as set forth in claim 10 wherein the step of forming the plurality of additional conductive layers comprises the steps of:

selecting a number of conductive layers to be formed on the interior of the tube;

setting a counter to an initial value;

checking a current value of the counter to see if it less than the selected number;

if the current value of the counter is less than the selected number, then performing the following steps:

a) pulsing a dose of a first precursor material in a carrier gas into the tube;

b) waiting a first preselected time period for the dose of the first precursor material to propagate along the inside of the tube and deposit on the interior surface along the length $I_1$;

c) pulsing a dose of the carrier gas only into the tube;

d) pulsing a dose of a second precursor material in the carrier gas into the tube;

e) waiting a second preselected time period for the dose of the second precursor material to propagate along the inside of the tube, deposit on the interior surface along the length $I_1$, and react with the first precursor material;

f) pulsing a second dose of the carrier gas only into the tube;

g) changing the first preselected time period;

h) changing the dose concentration of the first precursor material;

i) changing the second preselected time period;

j) changing the dose concentration of the second precursor material;

k) incrementing the value in the counter;

l) checking the incremented value of the counter to see if it is less than the incremented number; and if the incremented value of the counter is less than the selected number, then performing steps a) to l) again.

* * * * *